United States Patent [19]

Van Gompel

[11] 4,277,211

[45] Jul. 7, 1981

[54] MANUALLY OPERATED ADJUSTABLE RETAINER

[75] Inventor: James J. Van Gompel, Fremont, Ind.

[73] Assignee: Brammall, Inc., Angola, Ind.

[21] Appl. No.: 35,701

[22] Filed: May 3, 1979

[51] Int. Cl.[3] ..... B61D 45/00

[52] U.S. Cl. ..... 410/47; 410/36; 410/38; 410/97

[58] Field of Search ..... 410/36, 38, 39, 40, 410/47, 94, 95, 120, 140

[56] References Cited

U.S. PATENT DOCUMENTS

| | | | |
|---|---|---|---|
| 1,833,764 | 11/1931 | Tremblay et al. | 410/36 |
| 3,606,842 | 9/1971 | Verbick | 410/97 |
| 3,754,516 | 8/1973 | Van Gompel | 410/47 |
| 3,964,608 | 6/1976 | Rowley | 410/38 |

*Primary Examiner*—Richard A. Bertsch

*Attorney, Agent, or Firm*—Hill, Van Santen, Steadman, Chiara & Simpson

[57] ABSTRACT

An adjustable retainer for use simultaneously with various widths of cargo has four identical retainer sections, a first and a second section being disposed along the length of one side of a cargo carrying vehicle and a third and a fourth being disposed along the opposite side of the vehicle such that the first and the fourth retainer sections are opposite each other. Each retainer section is composed of a series of parallel flat elongated members each having a first and second end. Each first end of each flat member is pivotably fastened to the floor at the side wall of the vehicle. Each second end of each flat member is pivotably attached to a long angle member which in turn is attached to a long hollow cylindrical member. The hollow cylindrical members of each of the four retainer members may be positioned adjacent to the cargo. A pair of spanner bars each having two pivotal connections joins the first and the second retainer sections and the third and the fourth retainer sections. The two pivot points on each spanner bar compensate for the different widths of cargo to which the first and the fourth retainer sections are adjusted.

10 Claims, 6 Drawing Figures

MANUALLY OPERATED ADJUSTABLE RETAINER

BACKGROUND OF THE INVENTION

1. Field of the Invention

The invention relates to the field of adjustable retaining devices to restrain the movement of cargo within a cargo carrying vehicle.

2. The Prior Art

It has been known to build cargo restraining devices for single loads or multiple loads having the same width. Such restraining devices have been disclosed in U.S. Pat. No. 3,606,842 and U.S. Pat. No. 3,754,516. There has been a need for a cargo restraining device usable with loads having the same or varying widths.

BRIEF SUMMARY OF THE INVENTION

The invention, a manually operated adjustable retainer, is a mechanism for retaining various size loads within a cargo carrying vehicle. The invention in one embodiment is composed of four identical sections each pair of which is linked by a spanner bar pivoted in two places. Each of the four identical retainer sections has a plurality of short flat pivotal members. Each member has a first end affixed to the vehicle and a second end affixed to a long angle member. Each of the flat members being of the same length, is parallel to the other flat members of a given retainer section. The pivotal mounting of each of the flat members allows the long angular member to be moved laterally toward the load while remaining parallel to the side wall of the car or vehicle. Affixed to each of the long angle members is a long hollow tubular member having a locking mechanism mounted thereon at the spanner end of said tubular member.

Each of the four retainer sections is moved so as to be adjacent to the load or loads in the vehicle. Each pair of retaining sections, on the same side of the cargo, is joined together by a spanner bar pivoted in two places. An end of each spanner bar is inserted within one of the hollow cylindrical members affixed to each of the retainer sections of a given pair. Locking pins in the locking mechanisms enter borings in the ends of the spanner bars thereby locking the ends of the pivoted spanner bars to the hollow cylindrical members affixed to the retainer members.

The spanner bars, being pivoted in two places, allow the retainer sections to be adjusted to different widths of cargo at opposite ends of the vehicle. When a spanner bar is inserted between two retainer sections and locked therewith, the action of the two linked retainer sections is such that a lateral force generated by one load pressing against a first retainer section is offset by the other load pressing against the other retainer section, linked by the spanner bar to the first section.

The locking mechanism has a hollow, cylindrical body portion affixed perpendicularly to the elongated tubular member. A rotary cap affixed to the open end of the body member has a cam that engages a cam surface on the open end of the body member. The cam forces the cap laterally away from the elongated cylindrical member as the cap is rotated in a first direction.

As the cap is rotated in the first direction, a spring biased locking pin affixed to the rotary cap is also retracted from the hollow cylindrical member.

When the cap is rotated opposite to the first direction, thereby moving laterally toward the elongated tubular member, the spring biased locking pin moves laterally toward the end of a spanner bar that has been received by the elongated tubular member. When a boring through the spanner bar is opposite the spring biased locking pin, the pin passes through that boring thereby locking the spanner bar to the elongated tubular member.

DETAILED DESCRIPTION OF THE PREFERRED EMBODIMENTS

Figure 1:
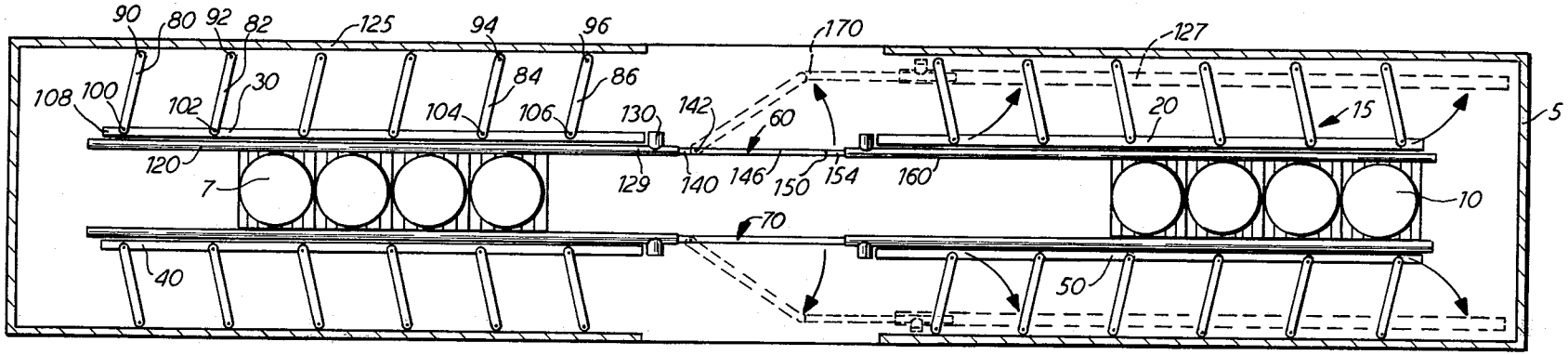
FIG. 1 is a top planar view of the interior of a cargo carrying vehicle showing the present invention mounted therein.

While the principles of the present invention find a particular utility in a manually operated adjustable retainer, it will be understood that the retainer mechanism may be utilized in other combinations. By way of exemplary disclosure of the best mode of practicing the invention there is shown generally in FIG. 1 a cargo carrying vehicle 5 transporting a load 7 and a load 10 not necessarily of the same width. An adjustable retainer 15 is comprised of a set of identical sections 20, 30, 40, and 50. The sections 20 and 30 are joined by a linking spanner bar 60. The sections 40 and 50 are joined by a linking spanner bar 70. Since the sections 20, 30, 40 and 50 are all identical, a description of section 30 will also suffice for the others. Since the linking spanner bars 60, 70 are identical, a description of the bar 60 will suffice for both.

The section 30, shown substantially fully extended in FIG. 1, comprises a series of identical flat members such as 80, 82, 84 and 86. Each of the members 80, 82, 84 and 86 is pivotally attached to the cargo carrying vehicle 5 at a first end 90, 92, 94 and 96. Any conventional means of pivotable attachment between the flat members 80, 82, 84 and 86 and the vehicle 5 is suitable so long as it will take the stresses and strains imposed on it by the loads 7 or 10. Each of the members 80, 82, 84 and 86 is positioned so as to be parallel to each of the other members 80, 82, 84 and 86 and is pivotably attached to a second end 100, 102, 104 and 106 to an elongated angle member 108. The elongated angle member 108 is attached by welding, for example, to a hollow elongated tubular member 120. Because of the pivotal connections at the first ends 90, 92, 94 and 96 and the second ends 100, 102, 104 and 106 the members 80, 82, 84 and 86 are able to rotate with respect to a side 125 of the vehicle 5, thereby allowing the tubular member 120 to be positioned adjacent to the load 7.

The section 20 is shown in a substantially fully extended position with respect to the side 125 of the vehicle 5. A substantially fully retracted position 127 for the member 20 is also indicated. Each of the sections 20, 30, 40 and 50 may be adjusted so that the tubular hollow members such as the member 120 are moved laterally with respect to the center of the vehicle 5 depending on the width of the load 7 or 10.

Affixed to an end 129 of the tubular hollow member 120 is pin puller 130. The pin puller 130 provides a locking mechanism for the spanner bar 60. The spanner bar 60 consists of a tubular member 140 pivotably joined at a point 142 to a second tubular member 146 which in turn pivotably joined at a point 150 to a third tubular member 154. The spanner or tubular members 140, 146 and 154 are designed to slide within the hollow members such as the member 120 and a member 160 corresponding to the member 120 which is affixed to the retainer section 20. All three spanner members 140,146 and 154 may be fully retracted into any of the cylindrical members 120 or 160 to allow loading or unloading of cargo.

When the retainer section 20 is in the fully retracted position 127, the spanner bar 60 assumes a position 170 whereby the tubular members 120 and 160 are still joined by the spanner bar 60.

Because of the fact that the sections 20 and 50 may be adjusted laterally with respect to the cargo 7 and 10 independently of the sections 30 and 40, the widths of the loads 7 and 10 can be different without losing the ability of the sections 20 and 50 and the sections 30 and 40 to be clamped against the loads 7 and 10, thereby holding them laterally stationary with respect to the vehicle 5. Because the spanner bars 60 and 70 each contain a pair of pivot points such as the pivot points 142 and 150 of the spanner bar 60 and because the pin pullers such as the pin puller 130 associated with the hollow tubular member 120 permit the spanner members 60 and 70 to be locked in their immediate positions, the sections 20, 30, 40 and 50 may assume and be held in any position between the retracted positions such as the retracted position 127 and the fully extended position for each of the sections 20, 30, 40 and 50 such as is shown in FIG. 1.

Figures 2, 6:
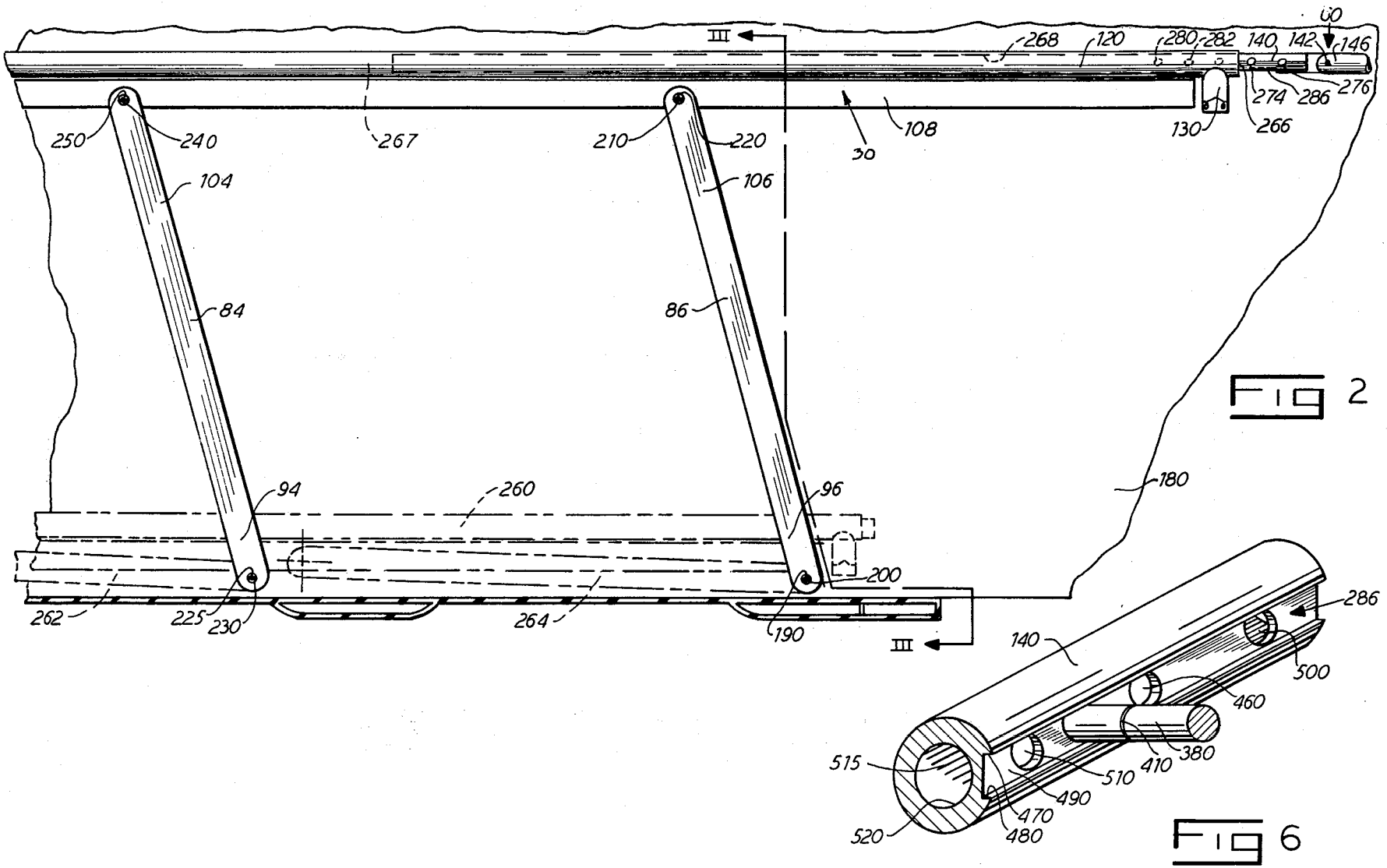
FIG. 2 is an enlarged fragmentary top view of a portion of one of the retainer members of the present invention mounted on the floor of a cargo carrying vehicle.
FIG. 6 is an isometric view of a portion of a spanner bar.

The details of the typical retainer section 30 affixed to a floor 180 of the vehicle 5 are in FIG. 2. The rigid, flat, elongated bar member 86 has a hole 190 at the first end 96 through which passes a retaining screw 200 for affixing the flat bar member 86 to the floor 180 of the vehicle 5. At the second end 106 of the bar member 86 is a second hole 210 through which passes a pin 220 which pivotably affixes the member 86 to the elongated angle member or connecting member 108. The member 84 has a hole 225 at the first end 94 through which passes a screw 230. The second end 104 has a hole 240 through which passes a pin 250. A retracted position 260 of the member 30 is also shown in FIG. 2. The flat members 84 and 86 assume positions 262, 264 adjacent to the side 125 of vehicle 5 in the retracted position.

The spanner bar 140 is also shown partially positioned within an end 266 the tubular hollow member 120. The tubular hollow member 120 has an interior cylindrical region 267 bonded by a cylindrical inner surface 268. Alignment holes 274 and 276 may be located in the spanner bar 140 to be aligned with holes 280 or 282 which may be located near the end 266 of the hollow tubular member 120. The spanner bar 140 also has a channel 286 which cooperates with the pin puller or locking mechanism 130 to lock the bar 140 to the retainer section 30.

Figure 3:
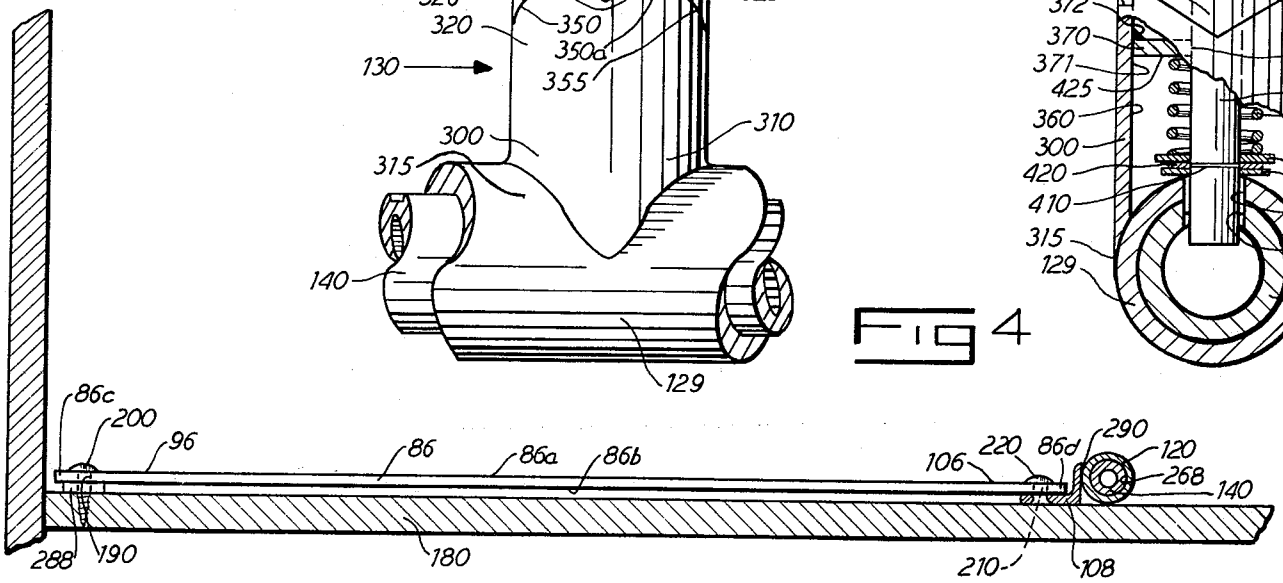
FIG. 3 is a section taken along line III—III of FIG. 2.

FIG. 3, a section along the line III—III of FIG. 2, shows the flat member 86 with a top surface 86*a*, a parallel bottom surface 86*b* and curved end surfaces 86*c*, 86*d*. The hole 190 through the first end 96 is shown through which is inserted the mounting screw 200. The screw 200 also passes through a spacer 288 before being imbedded in the floor 180 of the vehicle 5. The second end 106 of the flat bar member 86 has the hole 210 through which passes the pin 220. The pin 220 pivotably attaches the elongated angle member 108 to the flat member 86. The elongated angle member 108 is welded at a surface 290 to the hollow tubular member 120 which contains a portion of the hollow spanner bar 140.

Figure 4:
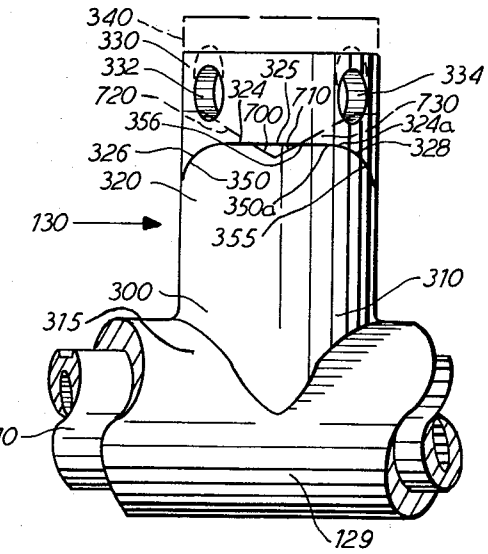
FIG. 4 is an enlarged planar view of a pin puller.

FIG. 4 is the pin puller or locking mechanism 130. The pin puller 130 has a cylindrical body portion 300 which is affixed at an end 310, by welding, to a surface 315 of the end 129 of the hollow cylindrical member 120. The body member 300 has a second end 320 which has a pair of flat cam surfaces 324, 324*a* joined by a detent 325 and connected to a pair of angular cam surfaces 326 and 328. Adjacent to the end 320 is a rotary cap 330 shown in the locking position. The rotary cap 330 has a set of four holes, of which two are shown 332 and 334. The four holes are located 90° from one another and 45° from a vertical or horizontal line. As a result, there will always be access to two of the holes without obstruction. A small screwdriver or bar may be inserted into one of two holes whereupon the rotary cap 330 may be turned with respect to the body member 300, thereby moving it from the locking position as shown in FIG. 4 to an unlocked or retracted position 340. The cap 330 has a pair of cams 350, 355 located 180° apart on the cap 330 and which are joined by a surface 350*a*. The rotary cap 330 moves to the unlocked position 340 when rotated as the cams 350 and 355 move along the cam surfaces 326 and 328, respectively, depending on which way the cap 330 is rotated. Rotary cap is operable in either direction each 90° of rotation locks or unlocks.

Figure 5:
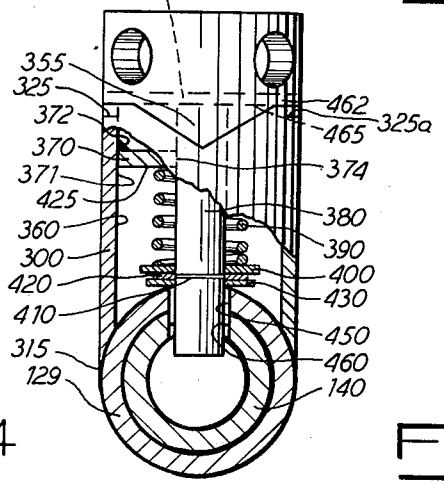
FIG. 5 is a partially broken away view of the pin puller of FIG. 4.

FIG. 5, a partially broken away view of the locking mechanism of FIG. 4 disclosing the details of the pin retraction mechanism. The body member 300 is hollow with an interior surface 360. An end plate 370 is welded in to an end 371 of the interior surface 360 with welds 372. The plate 370 has a centered hole 374 through which extends a locking pin 380. The pin 380 supports a coil spring 390 and a washer 400. A groove 410 in the pin 380 receives a "C" washer or split ring 420. The biasing spring 390 exerts a force against a surface 425 of the end plate 370 as well as against the washer 400 which in turn presses against the "C" washer 420. Thus, the spring 390 tends to drive the pin 380 toward tthe end 129 of the hollow cylindrical member 120. A second washer 430 is positioned on the pin 380 against the "C" washer 420. The end 129 of the hollow cylindrical member 120 has a boring 450 through which the pin 380 extends.

The pin 380 extends through the channel 286 and through a boring 460 in the spanner member 140 in the locking condition as shown in FIG. 5. When in the locking condition, the spanner member 140 is not able to travel longitudinally with respect to the hollow cylindrical member 120. The rotary cap 330 has a plate 462 and is affixed to an end 463 of the locking pin 380 at a surface 465 in any conventional fashion such as by welding. When the cap 330 has been rotated, such that the cam 355 rests on the flat surface 324, the locking pin 380 will be latched in the unlocked position, thereby permitting the spanner member 140 to travel longitudinally with respect to the hollow cylindrical member 120. When the cap 330 is rotated to the unlocked position, the distal end of the pin 380 does not retract far enough to become disengaged from the channel 286, thereby keeping the holes of both tubular members 140 and 129 oriented with each other.

FIG. 6 shows the channel 286 having a first side 470 and a second side 480 parallel to one another and perpendicular to a bottom 490 thereby giving the channel 286 a rectangular cross-section. The boring 460 through which the pin 380 may extend in a locking condition is also shown. Additional borings 500 and 510 may also be made in the bar 140. FIG. 6 shows the spanner bar 140 being hollow with an interior region 515 and a cylindrical interior surface 520.

For purposes of locking the adjustable retainers 20, 30, 40 and 50 against a load of cargo such as the cargo 7 or 10, the corresponding rotary caps 330 of each of the corresponding pin pullers 130 may be rotated to the pin retracted position thereby making it possible to align the hollow cylindrical members such as the member 120 against the cargo loads. Each of the pin pullers such as the pin puller 130 may then be placed in the pin extended position by rotating the cap 330 until the cam 355 moves from the flat surface 324 down the cam surface 328. When the member 330 is so rotated, the biasing spring 390 attempts to move the locking pin 380 into one of the borings such as the boring 460 or 500 or 510 in the member 140. Assuming that the pin 380 is not directly opposite a boring in the member 140, the pin 380 will travel into the channel 286 thereby preventing rotation of the spanner member 140. The members 20, 30, 40 and 50 may then be moved slightly toward or away from the load, thereby permitting the locking pin such as the pin 380 to enter the nearest boring such as the boring 460 in the spanner 140. At this point, each of the members 20, 30, 40 and 50 is locked with respect to the loads 7 and 10.

It should be noted that when one of the loads such as the load 10 moves laterally against one of the retaining members, such as the member 20, the spanner 60 in turn exerts a longitudinal force against the retaining member 30 which in turn drives it laterally against its cargo 7. Thus, the invention has the feature that the members 20 and 30 being connected by the spanner bar 60 tend to exert countervailing forces upon one another.

When a rail box car is subjected to lateral sway the cargo shifts from one side to the other. As the cargo shifts simultaneously against the retainers 20 and 30, the connecting member 60 is placed in tension, thereby section 20 is supported by section 30 and likewise 30 is supported by 20 like two substantially equal giants waging a tug of war.

When the cap 330 is rotated 90° from the locked position as shown in FIG. 4 into the extended position 340, also shown in FIG. 4, either the cam 350 or the cam 355 engages the detent 325. The detent 325 has a first surface 700 connected to the surface 324 and a second surface 710 connected to the surface **324*a*. The surfaces 700 and 710 form the V-shaped detent 325. The purpose of the detent 325 is to retain the cam 350 or 355 in an unlocked position while the retainer members are adjusted to the load. The cam 350 or 355, depending on the direction of rotation, has a first surface 720 and a second surface 730 which form a V-shaped cam corresponding to the surfaces 700 and 710 of the detent 325. Thus, the action of the cam 350 or 355 and the detent 325 results in a means whereby the rotary cap 330 may be positively locked in the retracted position. FIG. 5 discloses the fact that the locking means 130 has a pair of detents 325 and a second detent 325*a* located 180° apart from each other on the body member 300 and operable to receive either the cam 350 or 355 depending on which way the cap 330** is rotated.

Although various modifications might be suggested by those skilled in the art, it should be understood that I wish to embody within the scope of the patent warranted hereon all such modifications as reasonably and properly come within the scope of my constribution to the art.

I claim as my invention:

1. A retaining mechanism for simultaneously retaining cargo of first and second different widths within a cargo carrying vehicle wherein at least one elongated member against which cargo may be positioned is attached to the vehicle, the mechanism comprising:

first and second means for retaining located adjacent one another and attachable to a rigid surface of the cargo carrying vehicle on the opposite side of the cargo from the elongated member whereby said first means abuts at least a selected point of cargo having the first width and said second means abuts at least a selected point of cargo having the second width, means for linking receivable by said first and second means for retaining and lockable thereto whereby a rigid retaining mechanism comprising said first and second means for retaining and said means for linking is formed such that the cargo is non-movably retained between the elongated member and said first and second means.

2. The retaining mechanism according to claim 1, wherein said first and second means for retaining each include:

a plurality of spaced apart elongated retaining members each member of said plurality has a first and a second end, each of said first ends is pivotably connected to an elongated connecting member which can be positioned to abut the cargo to be restrained, each of said second ends is pivotally connectable to a selected surface of said cargo carrying vehicle whereby each of said elongated retaining members of said plurality is oriented essentially parallel to the rest of said elongated retaining members of said plurality.

3. The retaining mechanism according to claim 2, wherein said means for linking comprises:

a tubular member having three sections, each of said sections has a selected length, said three sections are pivotably joined by a first and a second means for pivoting, and said first and second means for retaining each include means for receiving an end of said tubular member and means for locking said end to said means for retaining.

4. A retaining mechanism suited to simultaneously retain cargo of two different widths within a cargo carrying vehicle comprising:

a first, second, third and fourth means for retaining;

a first and a second means for linking;

each of said means for retaining includes a plurality of elongated retaining members each member of which has a first and a second end, and an elongated connecting member with a means for locking affixed thereto;

each said retaining member is pivotably connected at a said first end to said elongated connecting member, and said second end of each said retaining member is pivotably attachable to a selected surface of the cargo carrying vehicle such that each of said retaining members is oriented parallel to each of said other retaining member whereby said elongated connecting member may be moved laterally with respect to the cargo;

each of said first, second, third and fourth means for retaining is affixable to a selected surface of the cargo vehicle by pivotably attaching each of said second ends to said members of said plurality to the selected surface of the cargo vehicle with said first and second means for retaining being positioned adjacent one another on a first side of the cargo and said third and fourth means for retaining being positioned adjacent one another on a second side of the cargo;

first and second linking means each having a first and a second end with a first and a second pivot point spaced therebetween such that said first and said second ends of said first linking means are receivable by said elongated connecting member of said first and second means for retaining and lockable thereto; and, said first and said second ends of said second linking means are receivable by said elongated connecting member of said third and fourth means for retaining and lockable thereto.

5. The retaining mechanism according to claim 4, wherein each of said means for linking comprises a first tubular member joined at said first pivot point to a second tubular member which is in turn joined at said second pivot point to a third tubular member.

6. The retaining mechanism according to claim 5, wherein each of said elongated connecting members comprises a hollow tubular member having said means for locking mounted thereon at a selected location.

7. The retaining mechanism according to claim 6, wherein each of said means for locking comprises:

a hollow housing affixed to said hollow tubular member, a cap member rotatably mounted thereon, a spring biased locking pin affixed to said cap and supported within said hollow housing and movable laterally by a means for retraction to engage a boring in a selected end of one of said means for linking.

8. The retaining mechanism according to claim 7, wherein said means for retraction comprises:

a cam surface on an end of said housing, a cam mounted on said cap member adjacent to and in contact with said end of said housing whereby said cam engages said cam surface resulting in said cap moving laterally, with respect to said housing, as said cap rotates in a first direction, thereby retracting said locking pin so that it no longer engages a selected boring in said end of one of said linking means.

9. An adjustable retainer operable for use in cargo vehicles for restraining loads having differing widths comprising:

at least a first and a second retainer member located adjacent one another and joined by a spanner bar, each of said retainer members includes a plurality of spaced apart elongated members each having a first and a second end, each of said first ends is pivotably affixable to the floor of the vehicle, each of said second ends is positioned so that each of said elongated members of said plurality are parallel to each other and each said second end is pivotably affixed to an elongated connecting member, said connecting member has a locking mechanism and is capable of receiving and locking an end of said spanner bar, whereby said first and said second retainer members may be positioned laterally with respect to cargo having differing widths and then joined by said spanner bar so as to thereby restrain the cargo.

10. The adjustable retainer according to claim 9, wherein said spanner bar comprises a spanner bar having a first tubular section pivotably attached to a second tubular section which is in turn pivotably attached to a third tubular section.

* * * * *